US008774445B2

(12) United States Patent
Ohtani et al.

(10) Patent No.: US 8,774,445 B2
(45) Date of Patent: Jul. 8, 2014

(54) BATTERY CASE OF HEADPHONE AND HEADPHONE HAVING THE SAME

(75) Inventors: Yoshiko Ohtani, Kanagawa (JP); Hiroyasu Suzuki, Kanagawa (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 13/526,692

(22) Filed: Jun. 19, 2012

(65) Prior Publication Data

US 2012/0328143 A1 Dec. 27, 2012

(30) Foreign Application Priority Data

Jun. 23, 2011 (JP) ..... 2011-139053

(51) Int. Cl.
*H04R 25/00* (2006.01)

(52) U.S. Cl.
USPC ..... 381/384; 381/370

(58) Field of Classification Search
USPC ..... 381/384, 71.6
See application file for complete search history.

(56) References Cited

U.S. PATENT DOCUMENTS

| | | | | |
|---|---|---|---|---|
| 5,607,795 | A * | 3/1997 | Saida | 429/100 |
| 7,026,948 | B1 * | 4/2006 | Rutter et al. | 340/693.5 |
| 7,412,070 | B2 | 8/2008 | Kleinschmidt et al. | |
| 7,970,159 | B2 | 6/2011 | Kleinschmidt et al. | |
| 2007/0060391 | A1 * | 3/2007 | Ikeda et al. | 463/46 |
| 2009/0003616 | A1 * | 1/2009 | Kleinschmidt et al. | 381/71.6 |
| 2012/0302348 | A1 * | 11/2012 | Karacal et al. | 463/38 |

FOREIGN PATENT DOCUMENTS

| | | | | |
|---|---|---|---|---|
| JP | 08079839 | A * | 3/1996 | H04Q 9/00 |
| JP | 2562708 | B2 | 9/1996 | |
| JP | 2005-287018 | | 10/2005 | |

* cited by examiner

*Primary Examiner* — Brian Ensey
*Assistant Examiner* — Norman Yu
(74) *Attorney, Agent, or Firm* — Whitham Curtis Christofferson & Cook, PC

(57) ABSTRACT

A case for storing a battery which supplies drive power for a headphone includes a case body to which the battery is stored and which is capable of being inserted to an insertion hole formed at a headphone chassis and a lock pawl which is capable of being locked with a lock hole formed at the headphone chassis, while a positive terminal which is connected to a positive electrode of the battery stored in the case body and a negative terminal which is connected to a negative electrode of the battery stored in the case body are arranged, and then, a leading terminal which is connected to either the positive electrode or the negative electrode is arranged at the case body and the leading terminal is connected to either the positive terminal or the negative terminal.

22 Claims, 5 Drawing Sheets

BATTERY CASE OF HEADPHONE AND HEADPHONE HAVING THE SAME

BACKGROUND OF THE INVENTION

1. Field of the Invention

The present invention relates to a battery case of a headphone for storing a battery to supply drive power for the headphone and a headphone having the battery case.

2. Description of the Related Art

There has been known a noise-cancelling headphone capable of providing music in preferable environment while cancelling ambient noise (hereinafter, also called environmental noise) by outputting as mixing the music with a cancelling signal which cancels the environmental noise (e.g., see Japanese Patent No. 2562708).

The noise-cancelling headphone disclosed in Japanese Patent No. 2562708 collects environmental noise with a microphone unit which is attached to a headphone chassis. The noise-cancelling headphone disclosed in Japanese Patent No. 2562708 converts the environmental noise into an electric signal. The noise-cancelling headphone disclosed in Japanese Patent No. 2562708 generates a cancelling signal to cancel noise which is audible for a user as passing through the headphone chassis based on the environmental noise converted into the electric signal. The noise-cancelling headphone disclosed in Japanese Patent No. 2562708 is configured to input the cancelling signal to a headphone speaker unit along with a music signal and to output the cancelling signal and the music signal from the headphone speaker unit.

Such noise-cancelling headphones require a power source to supply drive power to each structure. Further, wireless headphones also require a power supply to supply drive power for performing wireless communication. In a case that a battery is used as a power source in the above headphones, it is required to arrange a battery case to store the battery.

In general, a battery case of a headphone is fixed inside a headphone chassis and an opening portion is covered with a cover. Then, a battery is mounted to and dismounted from the battery case while opening and closing the cover (see Japanese Patent Application Laid-Open No. 2005-287018).

SUMMARY OF THE INVENTION

In the headphone having the abovementioned battery case, the battery case is not detachable as being fixed to the headphone chassis. Accordingly, maintenance ease thereof is poor as requiring to do repair while disassembling the entire headphone when a failure occurs at the battery case.

To address the above issues, the present invention provides a battery case of a headphone having excellent maintenance ease and a headphone having the battery case.

A battery case of a headphone according to the present invention includes a case body to which a battery is stored and which is capable of being inserted to an insertion hole formed at a headphone chassis of the headphone, and a lock pawl which is capable of being locked with a lock hole formed at the headphone chassis. Here, the case body is provided with a leading terminal which is connected to either a positive electrode or a negative electrode of the battery stored in the case body, and the leading terminal is capable of being connected to a contact terminal arranged at the headphone chassis.

Further, a headphone according to the present invention includes a headphone chassis and a battery case which is capable of being inserted to the headphone chassis. Here, the headphone adopts the abovementioned battery case.

According to the battery case of a headphone and the headphone having the battery case of the present invention, maintenance ease can be enhanced.

DETAILED DESCRIPTION OF EMBODIMENTS

In the following, a battery case of a headphone and the headphone having the battery case according to the present invention will be described with reference to the drawings.

Figure 1:
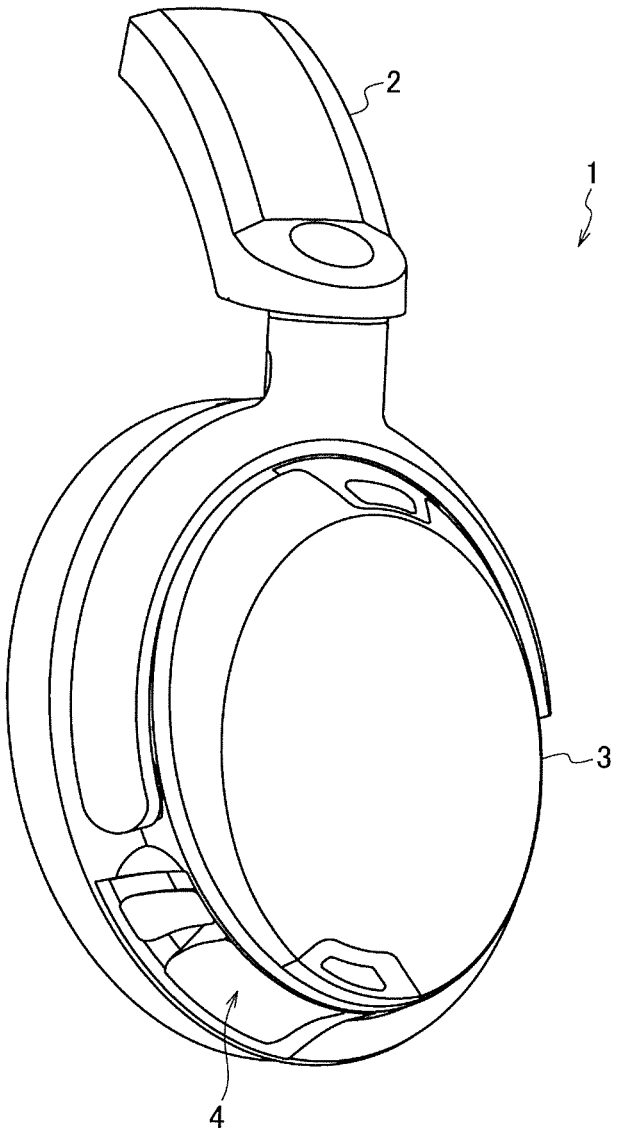
FIG. 1 is a perspective view of a main part illustrating an embodiment of a battery case and a headphone having the battery case according to the present invention.
Figure 2:
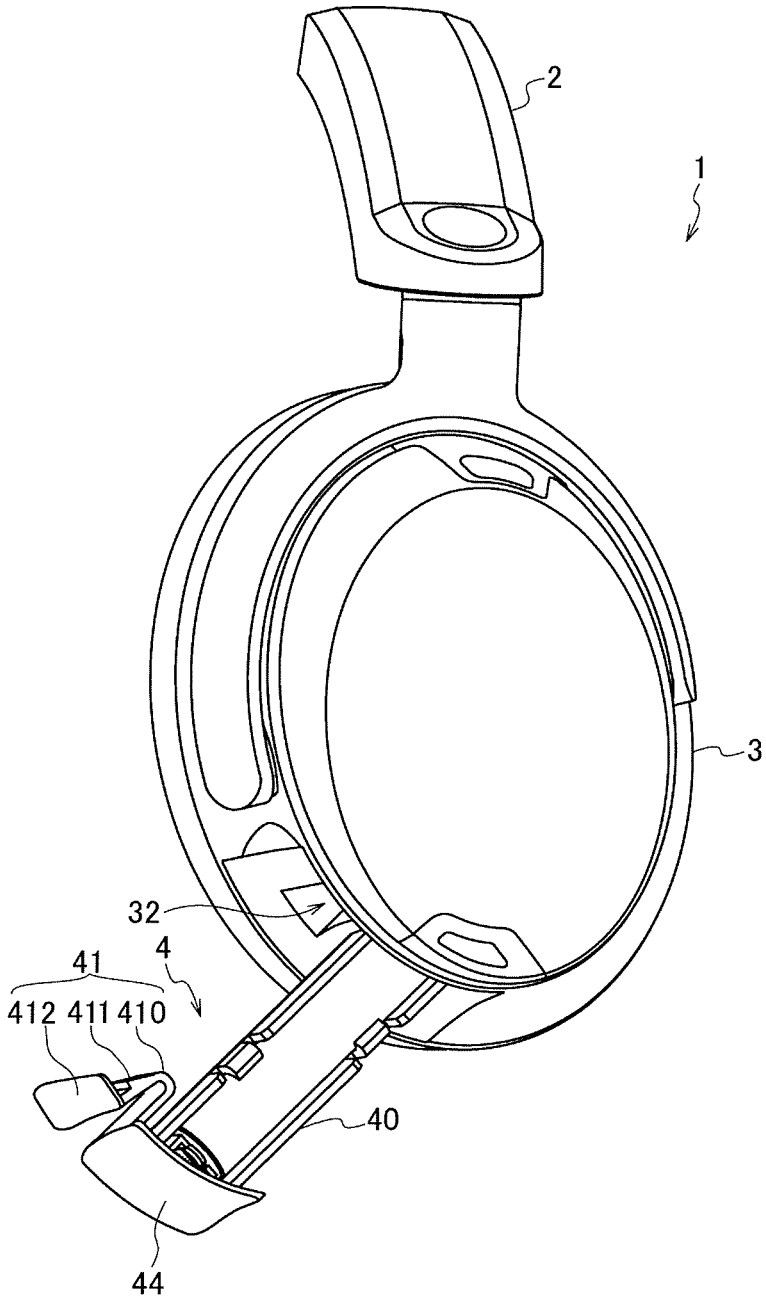
FIG. 2 is a perspective view of the main part illustrating a state that the battery case of FIG. 1 is pulled out.

As illustrated in FIGS. 1 and 2, a headphone 1 include a head band 2 and headphone chassis 3 arranged at both ends of the head band 2. In FIGS. 1 and 2, only one headphone chassis 3 is illustrated out of the right and left head chassis 3. A battery case 4 is attached to the one headphone chassis 3 in the vicinity of the lower end thereof. As described later, the battery case 4 is detachably attachable to the headphone chassis 3.

In FIGS. 1 and 2, only one end section of the head band 2 is illustrated. Actually, the head band 2 is an arch-shaped member having predetermined elastic force. When the headphone 1 is mounted on a head of a user, the head band 2 is elastically deformed in accordance with head size of the user. At that time, the head band 2 presses the head of the user with repulsive force against the elastic deformation. Thus, the headphone 1 is mounted on the head of the user.

Figure 5:
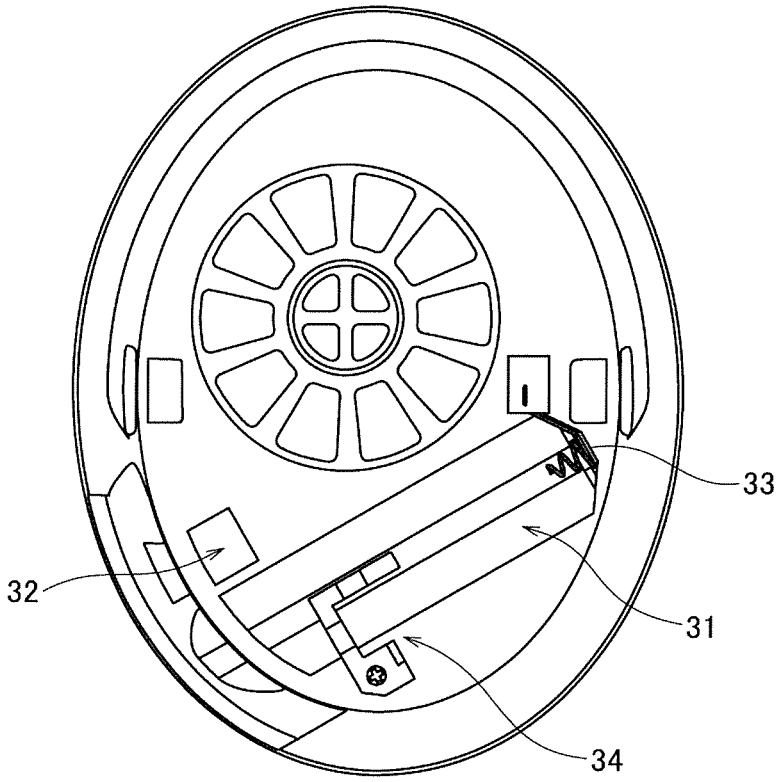
FIG. 5 is a sectional view of a main part of a headphone chassis.

The headphone chassis 3 is formed into a dome shape. The headphone chassis 3 includes a headphone unit (not illustrated), a microphone unit (not illustrated) which collects ambient noise, and the like which are assembled to the inside thereof. Further, as illustrated in FIG. 5, an insertion hole 31 to which the cylindrical battery case 4 is inserted and a lock hole 32 with which a lock pawl 41 of the battery case 4 is locked are arranged at a part of an outer wall of the headphone chassis 3.

The insertion hole 31 has diameter and depth so that the battery case 4 can be inserted thereto toward an obliquely-upper side from an obliquely-lower side of the headphone chassis 3. A negative terminal 33 to be connected to a negative electrode of a battery stored in the battery case 4 is arranged at the deepest part of the insertion hole 31. Further, a positive terminal 34 to be connected to a positive electrode of a battery via a later-mentioned leading terminal 46 of the battery case 4 is arranged at the inside of the vicinity of an opening portion of the insertion hole 31. The positive terminal 34 corresponds to a contact terminal according to the present invention. Both the negative terminal 33 and the positive terminal 34 are electrically connected to embedded components (not illustrated) such as the headphone unit and the microphone unit which are mounted inside the headphone chassis 3. That is, owing to that the negative terminal 33 and the positive terminal 34 are connected to the battery, drive power can be supplied to these embedded components.

Figure 3:
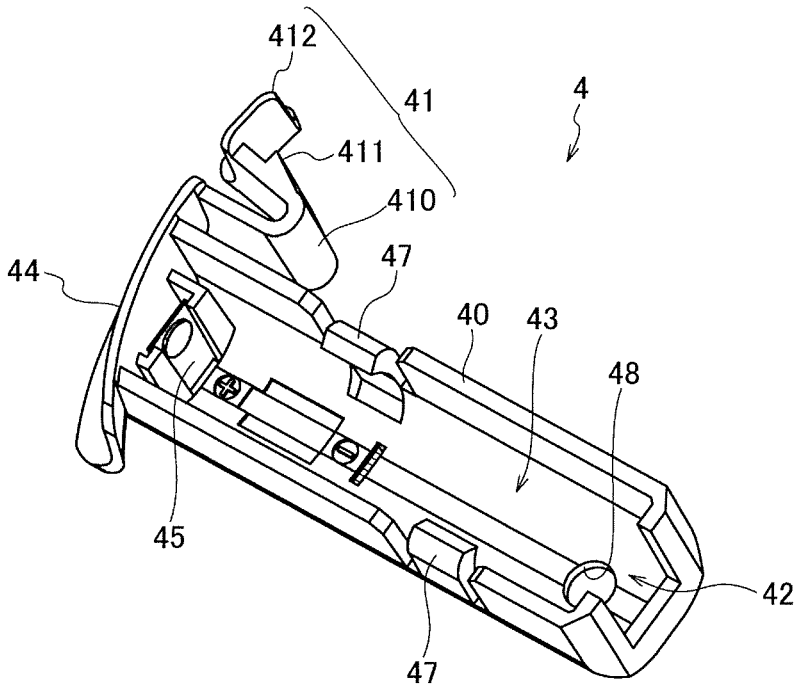
FIG. 3 is a top perspective view of the battery case.
Figure 4:
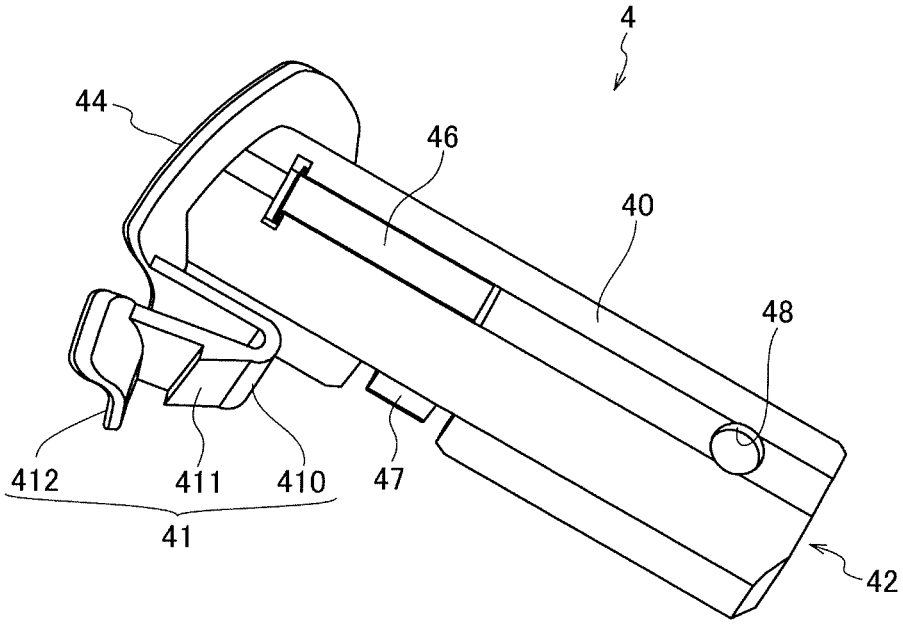
FIG. 4 is a bottom perspective view of the battery case.

As illustrated in FIGS. 3 and 4, the battery case 4 is a case shaped into an approximately quadrangular prism. The battery case 4 is formed of insulating material such as resin. The battery case 4 includes a case body 40 being capable of storing a battery (not illustrated). The case body 40 has an opening end 42 formed at one end in the longitudinal direction thereof. Owing to the opening end 42, the negative electrode of the battery is connected to the negative terminal 33 arranged at the headphone chassis 3 when the case body 40 storing the battery is inserted to the insertion hole 31.

Further, in the case body 40, one of side faces continuing to the opening end 42 (hereinafter, called opening side face 43) is also opened to enable a battery to be inserted and extracted. A part of an outer face in the longitudinal direction of the battery stored in the case body 40 is exposed from the opening side face 43.

The case body 40 has a counter end 44 at an end being opposite to the opening end 42. An outer face of the counter end 44 is formed to be flush with an outer face of the headphone chassis 3 when the battery case 4 is inserted to the insertion hole 31.

Further, a positive terminal 45 is arranged at an inner face of the counter end 44 of the battery case 4. Further, a leading terminal 46 is arranged as being extended along an outer side of the case body 40 as a terminal continuing to the positive terminal 45 which is located at the inner face of the counter end 44.

Here, the leading terminal 46 may be a negative terminal. In this case, the terminal arranged at the position corresponding to the negative terminal 33 arranged at the deepest part of the insertion hole 31 is to be the positive terminal.

The lock pawl 41 is structured integrally with the counter end 44 at an edge part of the outer face of the counter end 44 of the case body 40. The lock pawl 41 is formed of resin or the like which is the same as the material of the case body 40 as having elastic force.

The lock pawl 41 includes a curved portion 410 curved into a V-shape between a distal end and a base end connecting to the counter end 44. A convex portion 411 projecting outward is formed at the vicinity of the curved portion 410 of the lock pawl 41. Further, a tab 412 is formed at the distal end of the lock pawl 41.

The convex portion 411 is locked with a concave portion (not illustrated) which is formed at the vicinity of the opening portion of the lock hole 32 of the headphone chassis 3. Owing to that the convex portion 411 is locked with the concave portion, the battery case 4 is held at the headphone chassis 3 when being inserted to the insertion hole 31.

When the lock pawl 41 is locked with the lock hole 32, the tab 412 is exposed to a surface of the headphone chassis 3. For detaching the battery case 4 which is inserted to the headphone chassis 3, the curved portion 410 is deformed against elastic force thereof by pushing the tab 412 with a finger or the like of a user. Then, the convex portion 411 is separated from the concave portion of the lock hole 32. In this manner, locking of the battery case 4 with the headphone chassis 3 is released, so that the battery case 4 can be detached.

A holding pawl 47 which strongly holds the battery stored at the inside and prevents dropping thereof is arranged at an edge part of the opening side face 43 of the case body 40. Further, a detaching hole 48 through which a penetration member (not illustrated) is inserted is arranged at the vicinity (bottom face) of one end in the longitudinal direction of an outer face at the opposite side to the opening side face 43 of the case body 40 to enable the battery to be detached against holding force of the holding pawl 47. As illustrated in FIGS. 3 and 4, the detaching hole 48 is arranged at the vicinity of the opening end 42 at the outer face opposite to the opening side face 43 of the case body 40.

Here, it is also possible that the detaching hole 48 is arranged at the vicinity of the counter end 44 at the outer face opposite to the opening side face 43 of the case body 40.

For detaching the battery, the battery is pushed by inserting the rod-shaped penetration member, for example, a mini-plug at a top end of a headphone cord, to the detaching hole 48 from the outside of the battery case 4. In the headphone 1, the battery can be easily detached from the case body 40 owing to arranging the detaching hole 48.

Electric connection between the battery and the headphone chassis 3 is performed as follows.

First, the battery case 4 storing the battery is inserted to the insertion hole 31 of the headphone chassis 3. At that time, owing to that the convex portion 411 of the lock pawl 41 of the case body 40 is locked with the concave portion of the lock hole 32, the battery case 4 is maintained in a state of being attached to the headphone chassis 3.

In a state that the battery case 4 is attached to the headphone chassis 3 as described above, the positive electrode of the battery stored in the case body 40 is contacted to the positive terminal 45 arranged at the inner circumferential face of the case body 40. Then, owing to that the leading terminal 46 extended from the positive terminal 45 is contacted to the positive terminal 34 at the headphone chassis 3 side, electric connection between the positive electrode of the battery and the headphone chassis 3 side is established.

The negative electrode of the battery stored in the case body 40 is exposed from the opening end 42 of the case body 40. Accordingly, in a state that the battery case 4 is inserted to the insertion hole 31, the negative electrode of the battery is contacted to the negative terminal 33 which is arranged at the deepest part of the insertion hole 31 via the opening end 42 of the battery case 4. Thus, in the headphone 1, electric connection between the negative electrode of the battery and the headphone chassis 3 side is established.

For detaching the battery case 4 which is attached to the headphone chassis 3, the curved portion 410 of the lock pawl 41 is elastically deformed by pushing the tab 412 with a finger or the like of a user to separate the convex portion 411 from the concave portion of the lock hole 32. In this manner, locking of the battery case 4 with the headphone chassis 3 is released and the battery case 4 can be detached.

According to the battery case 4 of a headphone and the headphone 1 having the battery case 4 according to the present invention, the battery case 4 can be held by the headphone chassis 3 owing to that the case body 40 is inserted to the insertion hole 31 and the convex portion 411 of the lock pawl 41 is locked with the concave portion of the lock hole 32. According to the headphone 1 of the present invention, since the battery case 4 is detachably attachable to the headphone chassis 3, it is possible to replace only the battery case 4. That is, according to the headphone 1 of the present invention, the headphone 1 can be easily repaired by replacing only the battery case 4 in a case that the battery case 4 is damaged, for example. Thus, the headphone 1 according to the present invention is superior in maintenance ease.

Further, as described above, the battery case 4 is detachably attachable to the headphone chassis 3. Therefore, according to the headphone 1 of the present invention, various types of batteries can be used for the same headphone by preparing a plurality of battery cases 4 in which only internal structures are modified corresponding to the batteries having various sizes and shapes while the battery cases 4 have the same external shape.

Further, according to the headphone 1 of the present invention, electric continuity can be established only after the battery case 4 is inserted to the insertion hole 31. Therefore, according to the headphone 1 of the present invention, it is possible to prevent a user from accidentally touching the battery case 4 and the like of which electric continuity is established.

The abovementioned battery case 4 according to the present invention can be preferably used particularly for noise-cancelling headphones in which power is required to be supplied to a structure, a circuit and the like for performing noise-cancelling, wireless headphones in which power is required to be supplied for performing wireless communication, or the like.

What is claimed is:

1. A battery case of a headphone for storing a battery which supplies drive power for the headphone, comprising:

a case body to which the battery is stored and which is capable of being inserted to an insertion hole formed at a headphone chassis of the headphone;

a lock pawl which is capable of being locked with a lock hole formed at the headphone chassis; and a terminal arranged at the deepest part of the insertion hole, wherein the case body is provided with a leading terminal which is connected to one electrode of the battery stored in the case body, wherein a face of the case body opposing to the deepest part of the insertion hole is opened to enable the other electrode of the battery and the terminal to be connected, and wherein the leading terminal is capable of being connected to a contact terminal arranged at the headphone chassis.

2. The battery case of a headphone according to claim 1, wherein the case body includes a tab to release locking between the lock pawl and the lock hole, wherein the tab is formed integrally with the lock pawl, and wherein the tab is exposed to a surface of the headphone chassis when the lock pawl is locked with the lock hole.

3. The battery case of a headphone according to claim 1, wherein the leading terminal is arranged at an outer face of the case body.

4. The battery case of a headphone according to claim 1, wherein the terminal is a negative terminal, which is contacted to a negative electrode of the battery, and wherein the face of the case body opposing to the deepest part of the insertion hole is opened to enable the negative electrode and the terminal to be connected.

5. The battery case of a headphone according to claim 1, wherein the terminal is a positive terminal, which is contacted to a positive electrode of the battery, and wherein the face of the case body opposing to the deepest part of the insertion hole is opened to enable the positive electrode and the terminal to be connected.

6. The battery case of a headphone according to claim 1, wherein the case body includes an opening side face to enable the battery to be inserted and extracted, and wherein a part of an outer face in the longitudinal direction of the battery stored in the case body is exposed from the opening side face.

7. The battery case of a headphone according to claim 6 further comprising:

a holding pawl, which holds the battery stored in the case body, is arranged at an edge part of the opening side face.

8. The battery case of a headphone according to claim 7 further comprising:

a detaching hole through which a penetration member is inserted to push the outer face of the battery stored in the case body is arranged at the case body.

9. The battery case of a headphone according to claim 8, wherein the detaching hole is arranged at the vicinity of one end in the longitudinal direction of an outer face at the opposite side to the opening side face of the case body.

10. The battery case of a headphone according to claim 1, wherein the case body has a counter end which is to be flush with the headphone chassis when inserted to the insertion hole.

11. A headphone, comprising:

a headphone chassis; and a battery case, which is capable of being inserted to the headphone chassis, comprising:

a case body to which the battery is stored and which is capable of being inserted to an insertion hole formed at the headphone chassis of the headphone; and a lock pawl which is capable of being locked with a lock hole formed at the headphone chassis; and a terminal arranged at the deepest part of the insertion hole, wherein case body is provided with a leading terminal which is connected to one electrode of the battery stored in the case body, wherein a face of the case body opposing to the deepest part of the insertion hole is opened to enable the other electrode of the battery and the terminal to be connected, and wherein the leading terminal is capable of being connected to a contact terminal arranged at the headphone chassis.

12. The headphone according to claim 11, wherein the case body includes a tab to release locking between the lock pawl and the lock hole, wherein the tab is formed integrally with the lock pawl, and wherein the tab is exposed to a surface of the headphone chassis when the lock pawl is locked with the lock hole.

13. The headphone according to claim 11, wherein the leading terminal is arranged at an outer face of the case body.

14. The headphone according to claim 11, wherein the terminal is a negative terminal, which is contacted to a negative electrode of the battery, and wherein the face of the case body opposing to the deepest part of the insertion hole is opened to enable the negative electrode and the terminal to be connected.

15. A headphone according to claim 11, wherein the terminal is a positive terminal, which is contacted to a positive electrode of the battery, and wherein the face of the case body opposing to the deepest part of the insertion hole is opened to enable the positive electrode and the terminal to be connected.

16. The headphone according to claim 11, wherein the case body includes an opening side face to enable the battery to be inserted and extracted, and wherein a part of an outer face in the longitudinal direction of the battery stored in the case body is exposed from the opening side face.

17. The headphone according to claim 16 further comprising:

a holding pawl, which holds the battery stored in the case body, is arranged at an edge part of the opening side face.

18. The headphone according to claim 17 further comprising:

a detaching hole through which a penetration member is inserted to push the outer face of the battery stored in the case body is arranged at the case body.

19. The headphone according to claim 18, wherein the detaching hole is arranged at the vicinity of one end in the longitudinal direction of an outer face at the opposite side to the opening side face of the case body.

20. The headphone according to claim 11, wherein the case body has a counter end which is to be flush with the headphone chassis when inserted to the insertion hole.

21. The battery case of a headphone according to claim 1, wherein the battery case is detachably attachable to the headphone chassis.

22. The headphone according to claim 11, wherein the battery case is detachably attachable to the headphone chassis.

* * * * *